US005514142A

United States Patent [19]

Dean-Homolka

[11] Patent Number: 5,514,142

[45] Date of Patent: May 7, 1996

[54] DISPENSING PACIFIER

[76] Inventor: Shannon Dean-Homolka, 4145 E. Tanglewood Dr., Phoenix, Ariz. 85044

[21] Appl. No.: 349,424

[22] Filed: Dec. 5, 1994

[51] Int. Cl.[6] ..... A61J 17/00

[52] U.S. Cl. ..... 606/236; 606/234

[58] Field of Search ..... 604/77; 606/234–236; D24/194–199; 215/11.1–11.6

[56] References Cited

U.S. PATENT DOCUMENTS

| | | | |
|---|---|---|---|
| 2,612,165 | 9/1952 | Szuderski | 606/236 |
| 2,699,785 | 1/1955 | Allen | 606/236 |
| 3,610,248 | 10/1971 | Davidson | 606/236 |
| 3,875,940 | 4/1975 | Beuther | 604/77 |
| 5,078,733 | 1/1992 | Eveleigh et al. | 606/234 |
| 5,176,705 | 1/1993 | Noble | 606/236 |
| 5,395,392 | 3/1995 | Suhonen | 604/77 |

*Primary Examiner*—Stephen C. Pellegrino
*Assistant Examiner*—Glenn Dawson
*Attorney, Agent, or Firm*—Lowell E. Clark

[57] ABSTRACT

A dispensing pacifier for administering small quantifies of a liquid such as a medicine to an infant. The dispensing pacifier has a nipple member with a cavity for retaining and dispensing the liquid, and friction closure means for the nipple member. A flange encircles one end of the nipple member to prevent its ingestion. The nipple member and the friction closure means are connected by hinge means to prevent loss of the closure means.

1 Claim, 1 Drawing Sheet

DISPENSING PACIFIER

FIELD OF THE INVENTION

This invention pertains to a pacifier for holding and dispensing small quantities of a liquid, and, more particularly, small quantities of a liquid medicine.

BACKGROUND OF THE INVENTION

Pacifiers have been available in many different configurations. U.S. Pat. Nos. 3,645,613, 5,078,734, 5,123,915 and 5,176,705 describe how basic pacifier configurations may be modified to allow for the dispensing of small quantities of medicine. The embodiments disclosed in the aforesaid patents generally consist of a perforated nipple member together with a separate flange member for preventing ingestion of the nipple member and a separate closure member for the nipple member for avoiding loss of the medicine or other liquid. The disclosed configurations are fairly complex to manufacture and difficult to assemble due the number of separate components, and the relatively small closure member is susceptible to ingestion should it become detached from the rest of the pacifier assembly. Thus a need has existed to provide a dispensing pacifier which is simpler and cheaper to manufacture and assemble and which has no small elements which may easily become detached from the rest of the pacifier.

It is therefore an object of the present invention to provide a dispensing pacifier with fewer component parts than prior art devices.

It is another object of the present invention to provide a closure member for a dispensing pacifier which is connected with at least one other member of the pacifier.

It is a further object of this invention to provide a dispensing pacifier which is cheaper to manufacture than prior art devices.

It is yet another object of this invention to provide a dispensing pacifier which is easier to clean and reassemble than known prior art devices.

SUMMARY OF THE INVENTION

In accordance with the various embodiments of this invention, it is an object to provide an improved dispensing pacifier.

It is another object of this invention to provide a dispensing pacifier of simplified construction with a friction cap member for retaining a liquid inside a dispensing nipple member.

It is a further object of this invention to provide a dispensing pacifier with a friction cap member having an integral hinge member for attaching the cap member to the dispensing pacifier.

In accordance with one embodiment of this invention, a substantially one-piece dispensing pacifier is disclosed. A nipple member for containing a liquid such as a medication is closed by a friction cap formed together with the nipple member; the two members are joined by a strap-like hinge member to prevent their separation.

In accordance with another embodiment of this invention, there is disclosed a dispensing pacifier having a flange, a collar, and a friction cap. The collar fits inside a nipple member to secure the nipple to the flange. The friction cap fits inside the collar to close the dispenser. The flange, the collar, and the cap are formed in the same piece of material, and strap-like hinge members connect the three elements.

In accordance with yet another embodiment of this invention, a dispensing pacifier is disclosed having a flange, a collar, and a friction cap. The cap and the collar are formed from a single piece of material and are joined by a hinge member. The collar fits inside a nipple member which in turn fits inside the flange to secure the components together.

The foregoing and other objects, features, and advantages of the invention will be apparent from the following, more particular, description of the preferred embodiments of the invention, as illustrated in the accompanying drawings.

DETAILED DESCRIPTION OF THE INVENTION

Figure 1:
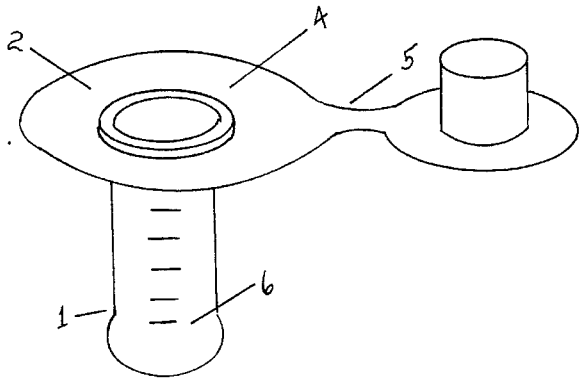
FIG. 1 is a perspective view of a preferred embodiment of a dispensing pacifier according to the present invention.

Referring to FIG. 1, there is illustrated an apparatus for the oral administration of a liquid such as a medicine.

Figure 2:
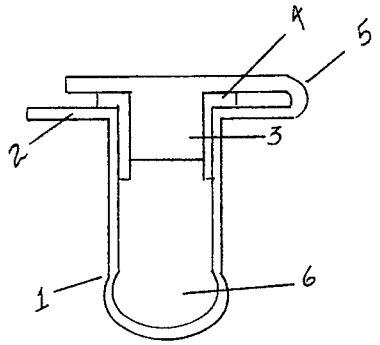
FIG. 2 is a cross-sectional view of the dispensing pacifier of FIG. 1.

The apparatus comprises a nipple member 1 for containing a suitable liquid. The lower extremity of the nipple member is pierced to allow dispensation of the liquid A flange 2 surrounds the upper end of the nipple to prevent its ingestion. A stopper-like friction member 3 is configured to close the chamber 6 formed by the nipple member 1, as shown in the cross-sectional view of FIG. 2. A hinge-like strap member 5 is integral with both the nipple member 1 and the friction closure member 3 so that the components will not become separated and lost. Since the nipple member 1 is preferably formed from latex which is easily deformable, it may be desirable to add a collar member 4 formed from a stiffer material such as PVC to facilitate insertion and retention of the friction closure member 3. Alternatively, the nipple member 1, the friction closure member 3, and the hinge member 5 connecting them may be integrally formed from a material such a silicone without the inclusion of the collar member 4 in order to provide a one-piece dispensing pacifier.

Figure 3:
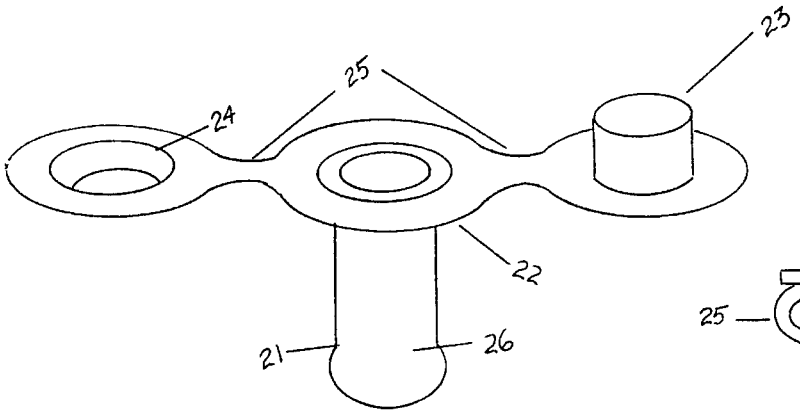
FIG. 3 is a view in perspective of another preferred embodiment of a dispensing pacifier according to the present invention.
Figure 4:
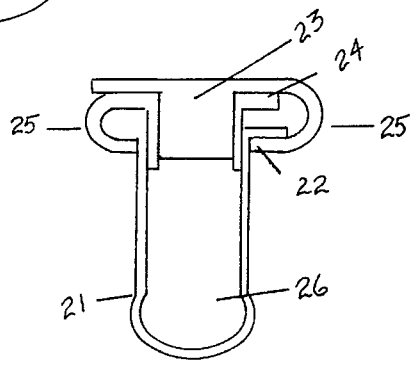
FIG. 4 is a cross-sectional view of the apparatus of FIG. 3.

Referring now to FIG. 3, a two-piece embodiment of a dispensing pacifier is shown. Here, 21 is a nipple member formed of a soft material such as latex. The flange 22, a collar 24, and friction closure 23 are all formed from a single piece of moderately stiff material, such as PVC. The collar member 24 and the closure member 23 are both retained with the flange member 22 by hinge-like swaps 25. As shown in the cross-sectional view of FIG. 4, the nipple member 21 is inserted through a hole in the flange 22, the collar member 24 is inserted in the nipple 21 so that it is retained in the flange 22, and the stopper 23 is inserted into the collar 24 to close the nipple reservoir 26 and complete the dispensing pacifier assembly.

Figure 5:
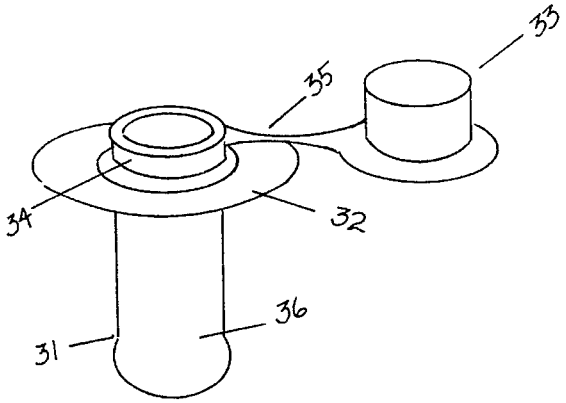
FIG. 5 is a perspective view of yet another preferred embodiment of a dispensing pacifier.
Figure 6:
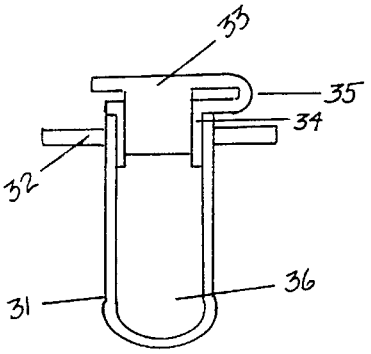
FIG. 6 is a view in cross-section of the embodiment of FIG. 5.

Referring now to FIG. 5, a third embodiment of a dispensing pacifier is shown. Here a flexible nipple member 31 is inserted into a flange 32 formed, for example, from PVC. A hard plastic collar 34 is inserted into the upper end of the nipple member 31 to retain the nipple member 31 in the flange 32. The nipple reservoir 36 is closed by friction cap 33, which fits snugly inside collar 34. The cap 33 and the collar 34 are connected by a hinge member 35. Preferably, cap 33, collar 34, and hinge 35 are formed from a single piece of material.

While the invention has been particularly shown and described with reference to preferred embodiments thereof, it will be understood by those skilled in the are that the foregoing and other changes in form and details may be made without departing from the spirit and scope of the invention.

What is claimed is:

1. A dispensing pacifier, comprising, in combination:

flexible nipple means for containing and dispensing a liquid, flange means surrounding a portion of said flexible nipple means for preventing ingestion of said pacifier, friction closure means for retaining a liquid in said flexible nipple means, collar means in said nipple means between said nipple means and said friction closure means for facilitating insertion and retention of said friction closure means, and hinge means for connecting said flange means with said collar means and said friction closure means, wherein said nipple means comprises a first soft material and said flange means, said collar means, said friction closure means and said hinge means all comprise a single piece of a second material of a different type from said first soft material.

* * * * *